US006228833B1

(12) United States Patent
Paatz et al.

(10) Patent No.: US 6,228,833 B1
(45) Date of Patent: May 8, 2001

(54) METHOD FOR PRODUCING SCENT INTENSIFYING WASHING AND CLEANING DETERGENTS

(75) Inventors: Kathleen Paatz, Duesseldorf; Wolfgang Lahn, Willich, both of (DE)

(73) Assignee: Henkel Kommanditgesellschaft Auf Aktien, Duesseldorf (DE)

( * ) Notice: Subject to any disclaimer, the term of this patent is extended or adjusted under 35 U.S.C. 154(b) by 0 days.

(21) Appl. No.: 09/529,864

(22) PCT Filed: Oct. 14, 1998

(86) PCT No.: PCT/EP98/06513

§ 371 Date: Aug. 7, 2000

§ 102(e) Date: Aug. 7, 2000

(87) PCT Pub. No.: WO99/21955

PCT Pub. Date: May 6, 1999

(30) Foreign Application Priority Data

Oct. 23, 1997 (DE) ..... 197 46 781

(51) Int. Cl.[7] ..... C11D 17/00
(52) U.S. Cl. ..... 510/444; 510/101
(58) Field of Search ..... 510/101, 444

(56) References Cited

U.S. PATENT DOCUMENTS 5,198,145 * 3/1993 Lobunez et al. ..... 252/174.14
5,691,294 * 11/1997 France et al. ..... 510/349

FOREIGN PATENT DOCUMENTS

537584 A1 * 4/1993 (EP) .
WO 91/02047 * 2/1991 (WO) .
WO 91/13678 * 9/1991 (WO) .
WO 94/09111 * 4/1994 (WO) .
WO 95/11291 * 4/1995 (WO) .
WO 96/29389 * 9/1996 (WO) .
WO 97/20906 * 6/1997 (WO) .
WO 97/47720 * 12/1997 (WO) .
WO 98/12299 * 3/1998 (WO) .

* cited by examiner

*Primary Examiner*—John Hardee
(74) *Attorney, Agent, or Firm*—Wayne C. Jaeschke; Glenn E.J. Murphy; Daniel S. Ortiz

(57) ABSTRACT

Scent intensifying washing and cleaning detergents or components for these detergents are manufactured in which a solid and essentially water-free premix is produced, said premis being comprised of washing and cleaning detergent compounds and/or washing and cleaning detergent materials. The premix contains at least 0.1 wt. % perfume referring to the premix and is subjected to granulation or compacted agglomeration. By virtue of the water-free method, subsequent drying steps do not apply in which the prefume is entirely or partially vaporized. The homogenous incorporation of the prefume leads to a substantially increased fragrance of both the product as well as the articles which are dampened or dried, especially textiles.

27 Claims, No Drawings

METHOD FOR PRODUCING SCENT INTENSIFYING WASHING AND CLEANING DETERGENTS

FIELD OF THE INVENTION

This invention relates to a process for the production of solid perfume-enhanced detergents. More particulaly, the invention relates to a process for the production of perfume-enhanced detergents with bulk densities above 600 g/l by press agglomeration of a substantially water-free premix.

BACKGROUND OF THE INVENTION

The perfuming of solid detergents is now standard practice in the art. These products are perfumed on the one hand to provide the consumer with a recognizable and "unmistakable" product in conjunction with the structure and color impression; on the other hand, the incorporation of perfumes is intended to ensure that the articles treated with the detergents, more particularly fabrics, are given a long-lasting perfume which is regarded by the consumer as a performance feature of the particular detergent. Normally, those auxiliaries which do not make a direct contribution to the washing or cleaning process are added last to the detergents. This procedure applies in particular to the "aesthetic" components, such as dyes and perfumes. Perfume is mostly incorporated by spraying the solid detergent granules with perfume which is optionally fixed with powder components to the surface of the solid detergent. The disadvantage of this procedure is that the perfumes are not uniformly distributed throughout the detergent and, in addition, can be partly removed during subsequently drying steps. In addition, the perfume impression of the detergents or rather the articles treated with them is often not sufficiently intensive with this method of perfuming and can only be made satisfactory by increasing the amount of perfume used.

The production of detergent granules is widely described in the prior art literature where, besides numerous patent specifications, there are an enormous number of publications concerned with this subject ranging from individual articles in specialist journals to complete works.

Compacted detergents and processes for their production are described, for example, in DE-A-39 26 253 and DE-A-195 19 139 (both Henkel KGaA). These two documents describe the extrusion of water-containing solid mixtures in the presence of added plasticizers and/or lubricants. There is no reference in either document to the use of perfumes. However, since the extrudates produced without perfumes contain water and have to be subsequently dried, any perfuming required can only be carried out by the conventional method of spraying onto the already dried extrudates.

Earlier German patent application 196 38 599.7 (Henkel KGaA) describes a water-free or substantially water-free extrusion process in which subsequent drying steps can be omitted because a substantially water-free premix with a water content of preferably no more than 15% by weight (this water not being present in free form) is extruded. The perfuming of the extrudates obtained is not mentioned in this document either.

In order to solve the problem of the inadequate perfuming of articles treated with detergents, perfume-containing particles, in which the perfume is so to speak "encapsulated", have been described in the prior art. In particular, complexes of cyclodextrins and perfume are described in the prior art as strong perfumes and fragrances for use in detergents, cf. for example EP 602 139, U.S. Pat. No. 5,236,615 and EP 397 245 (all Procter & Gamble).

Microencapsulated perfume oils are also used for this purpose, the perfume preferably being activated in a dryer, cf. EP 376 385 (Procter & Gamble).

The solutions proposed in the cited prior art mainly extend to the perfuming of the treated and dried textiles. If it is desired that the product itself or the freshly washed and still damp laundry should also be olfactorily more noticeable, it has to be additionally sprayed with perfume in the conventional way which, besides the production of the perfume particles, involves another process step.

BRIEF DESCRIPTION OF THE INVENTION

Now, the problem addressed by the present invention was to provide a process by which it would be possible to produce perfume-enhanced detergents or detergent components which would provide not only dry laundry, but also damp laundry with a stronger perfume and which, as detergents per se, would also perfume much more noticeably than conventionally perfumed detergents.

It has now been found that detergents having the required properties can be obtained by producing a solid perfume-containing premix which is substantially free from water and subjecting this premix to press agglomeration.

The present invention relates to a process for the production of perfume-enhanced detergents or detergent components with bulk densities above 600 g/l, characterized in that a solid and substantially water-free premix containing at least 0.1% by weight of perfume, based on the premix, is prepared from detergent compounds and/raw materials and is subjected to press agglomeration.

DETAILED DESCRIPTION OF THE INVENTION

In the context of the invention, the expression "substantially water-free" is understood to apply to a state in which the content of liquid water, i.e. water which is not present as water of hydration and/or water of constitution, is below 2% by weight, preferably below 1% by weight and, more preferably, even below 0.5% by weight, based on the premix. Accordingly, water can only be introduced into the process for producing the premix in chemically and/or physically bound form or as a constituent of the raw materials or compounds present as solids, but not as a liquid, solution or dispersion. The premix advantageously has a total water content of not more than 15% by weight, i.e. the water is present in chemically and/or physically bound form and not in liquid, free form. In a particularly preferred embodiment, the content of water not bound to zeolite and/or to silicates in the solid premix is no more than 10% by weight and preferably no more than 7% by weight.

Detergents in the context of the invention are understood to be compositions which may be used for washing or cleaning without other ingredients normally having to be added. By contrast, a component for detergents consists of at least 2 constituents normally used in detergents. However, components or so-called compounds are normally only used in admixture with other components, preferably together with other compounds.

The ingredients used in the process according to the invention, except for the nonionic surfactants liquid at temperatures below 45° C./1 bar pressure, may be separately produced compounds and also raw materials which are present in powder or particulate form (fine to coarse particles). The particles may be, for example, beads produced by spray drying or (fluidized-bed) granules, etc.

Basically, the composition of the compounds is not crucial to the invention, except for their water content which has to be gauged in such a way that the premix is substantially water-free as defined above and preferably contains no more than 10% by weight of water of hydration and/or water of constitution. In one preferred embodiment, overdried compounds are used in the premix. Such compounds may be obtained, for example, by spray drying, the temperature being controlled in such a way that the tower exit temperatures are above 70° C., for example 85° C. or higher. Solid compounds serving as carriers for liquids, for example liquid nonionic surfactants or silicone oil and/or paraffins, may also be used in the premix. These compounds may contain water within the limits mentioned above, the compounds being free-flowing and remaining free-flowing or at least transportable even at relatively high temperatures of at least 45° C. In a particularly preferred embodiment, however, compounds containing at most 10% by weight and, more particularly, at most 7% by weight of water, based on the premix, are used in the premix. Free water, i.e. water which is not bound in any way to a solid and which is therefore present "in liquid form" is preferably not present at all in the premix because even very small quantities, for example of 0.2 or 0.5% by weight, based on the premix, are sufficient to partly dissolve the basically water-soluble binder. This would result in the melting point or softening point being reduced and the end product losing both flowability and bulk density.

It has surprisingly been found that the solid raw material to which or the solid compound in which the water is bound is by no means irrelevant. Thus, water attached to builders, such as zeolite or silicates (for a description of the substances, see below), more particularly to zeolite A, zeolite P or MAP and/or to zeolite X, may be regarded as relatively non-critical. By contrast, water bound to other solid components than the builders mentioned is preferably present in the premix in quantities of less than 3% by weight. In one particularly advantageous embodiment, the premix does not contain any water which is not bound to the builders. However, this is technically difficult to achieve because, in general, traces of water at least are always introduced by the raw materials and compounds.

According to the invention, the substantially water-free premixes contain perfume, at least 0.1% by weight of perfume, based on the premix, being added.

The incorporation of the perfume in the premix and the subsequent press agglomeration step provides for the uniform distribution of the perfumes throughout the detergent or the detergent component. Since a substantially water-free premix is used, there is no need for subsequent drying steps where perfume could partly or completely evaporate. The selective incorporation of the perfume in the detergents or detergent components also provides for a distinctly reduced loss of perfume in transit and during storage. Compared with conventionally perfumed detergents, not only is the perfume much more uniformly distributed, the product also has a more intensive perfume impression. In this way, products can be perfumed with less perfume for the same olfactory impression or, alternatively, considerably improved perfume impressions can be obtained for the same amount of perfume. The improvement in the perfume impression comes clearly to light not only on the perfumed product, but also on the treated articles, preferably textiles. Both on damp and on dry laundry, the detergents leave behind a stronger perfume impression than conventionally perfumed press agglomerates. By virtue of the fact that the perfumes are uniformly distributed throughout the press agglomerate as a whole, the problems associated with conventional perfuming are also avoided. Since the capacity of the agglomerates to absorb sprayed-on perfume is minimal and continues to decrease with increasing degree of compression, most of the perfume adheres to the powdering agent. The conventionally perfumed product inevitably moved around in transit loses part of the powdering agent—which carries most of the perfume—through friction. In the event of further movement, these loose "fines" fall through the relatively coarse-particle bed of solids and collect at the bottom of the containers, so that a certain percentage of perfume makes virtually no contribution towards perfuming of the product and no contribution whatever to perfuming of the treated articles. These disadvantages are also avoided by the process according to the invention.

The perfume oils or perfumes used in the process according to the may be individual perfume compounds, for example synthetic products of the ester, ether, aldehyde, ketone, alcohol and hydrocarbon type. Examples of perfume compounds of the ester type are benzyl acetate, phenoxyethyl isobutyrate, p-tert.butyl cyclohexyl acetate, linalyl acetate, dimethyl benzyl carbinyl acetate (DMBCA), phenyl ethyl acetate, benzyl acetate, ethyl methyl phenyl glycinate, allyl cyclohexyl propionate, styrallyl propionate, benzyl salicylate, cyclohexyl salicylate, floramate, melusate and jasmecyclate. The ethers include, for example, benzyl ethyl ether and Ambroxan; the aldehydes include, for example, linear alkanals containing 8 to 18 carbon atoms, citral, citronellal, citronellyloxy acetaldehyde, cyclamen aldehyde, lilial and bourgeonal; the ketones include, for example, ionones, α-isomethyl ionone and methyl cedryl ketone; the alcohols include anethol, citronellol, eugenol, geraniol, linalool, phenyl ethyl alcohol and terpineol while the hydrocarbons include, above all, terpenes, such as limonene and pinene. However, mixtures of different perfumes which together produce an attractive perfume note are preferably used.

Perfume oils such as these may also contain natural perfume mixtures obtainable from vegetable sources, for example pine, citrus, jasmine, patchouli, rose or ylang-ylang oil. Also suitable are clary oil camomile oil, clove oil, melissa oil, mint oil, cinnamon leaf oil, lime blossom oil, juniper berry oil, vetiver oil, olibanum oil, galbanum oil and labdanum oil and orange blossom oil, neroli oil, orange peel oil and sandalwood oil.

The substantially water-free premix which is subjected to press agglomeration preferably contains no dust-fine particles and, in particular, no particles below 200 μm in size. Particularly preferred particle size distributions are those where at least 90% by weight of the particles are at least 400 μm in diameter. In one particularly preferred embodiment of the invention, at least 70% by weight, preferably at least 80% by weight and more preferably up to 100% by weight of the detergents or detergent components produced by press agglomeration consist of spherical or substantially spherical (bead-like) particles with a particle size distribution where at least 60% by weight of the particles are between 0.8 and 2.0 mm in size.

The solid and substantially water-free premix contains typical solid detergent ingredients such as, for example, builders, solid surfactants, bleaching agents, bleach activators, polymers and other typical ingredients. As described above, these ingredients may be used individually or in the form of compounds optionally impregnated with liquid or paste-form detergent ingredients such as, for example, silicone oils, paraffins or liquid nonionic surfactants. Premixes containing individual raw materials and/or compounds which are present as solids at room temperature/1 bar pressure and which have a melting or softening point of no lower than 45° C. and optionally up to 20% by weight, preferably up to 15% by weight and more preferably up to 10% by weight, based on the premix, of nonionic surfactants liquid at temperatures below 45° C./1 bar pressure are preferably used in accordance with the present invention. The nonionic surfactants used are preferably the alkoxylated alcohols typically used in detergents, such as fatty or oxo alcohols, so that a preferred process is characterized in that, in addition to the solid constituents, the premix additionally contains up to 20% by weight, preferably up to 15% by weight and more preferably up to 10% by weight of nonionic surfactants liquid at temperatures below 45° C./1 bar pressure, more particularly the alkoxylated alcohols typically used in detergents, such as fatty alcohols or oxo alcohols containing between 8 and 20 carbon atoms and, in particular, an average of 3 to 7 ethylene oxide units per mole of alcohol, the liquid nonionic surfactants preferably being added in admixture with the perfume.

In order to facilitate the press agglomeration of the premix and to improve the physical properties of the perfume-enhanced detergents or detergent components obtained by press agglomeration, the premix may contain a raw material or a compound which acts as a binder and disintegration aid. These binders and disintegration aids act as lubricants and adhesives in the press agglomeration step, bonding the solid particles of the premix to one another and making it easier for the premix to pass through the compression zone of the press agglomeration units. In addition, as water-soluble binders, they facilitate the redissolution of the press agglomerates because they act as disintegrators in water. In a preferred process according to the invention, the premix contains at least one raw material or one compound which is present in solid form at temperatures below 45° C./1 bar pressure, but which exists as a melt during the press agglomeration step, this melt acting as a polyfunctional water-soluble binder which, in the production of the detergents, acts both as a lubricant and as an adhesive for the solid detergent compounds or raw materials, but has a disintegrating effect during the redissolution of the detergent in water.

Binders suitable for use in the process according to the invention are solid at temperatures below 45° C./1 bar pressure, but exist as a melt under the process conditions of the press agglomeration step. The binder may be incorporated in the premix by spraying a melt of the binder or binder mixture onto the premix or by adding such a melt dropwise to the premix. However, the binder (mixture) may also be incorporated in the premix as a fine-particle solid.

The nature of a suitable binder and the temperature prevailing in the compacting step of the press agglomeration process are interdependent. Since it has been found to be of advantage for the binder to be distributed as uniformly as possible in the material to be compacted in the compacting step of the process, temperatures at which the binder at least softens and, preferably, is present completely and not just partly in molten form must prevail in the compacting step of the process. If, therefore, the binder selected has a high melting point or a high softening point, a temperature which ensures that the binder melts must be established in the compacting step of the process. In addition, depending on the desired composition of the end product, temperature-sensitive raw materials should also lend themselves to processing. In this case, the upper temperature limit is imposed by the decomposition temperature of the sensitive raw material, the compacting step preferably being carried out at temperatures significantly below the decomposition temperature of this raw material. By contrast, the lower limit to the melting point or rather to the softening point is of such considerable significance because, with softening points or melting points below 45° C., the end product obtained will generally tend to become tacky even at room temperature and slightly elevated temperatures of around 30° C., i.e. at summer temperatures, and under storage or transportation conditions. It has proved to be of particular advantage to carry out the compacting step a few degrees, for example 2 to 20° C., above the melting point or rather above the softening point.

Without wishing to be confined to this theory, applicants are of the view that, by virtue of the homogeneous distribution of the binder in the premix, the solid compounds and the individual raw materials optionally present are coated by the binder under the process conditions of the compacting step and then bonded to one another in such a way that the end products are made up almost exactly of these numerous small individual particles that are held together by the binder which acts as a preferably thin partition between these individual particles. In idealized form, the structure may be described as resembling a honeycomb in which the cells are filled with solids (compounds or individual raw materials). On contact with water, even cold water, i.e. for example at the beginning of an automatic wash cycle, the thin partitions mentioned dissolve or disintegrate almost instantaneously. Surprisingly, this is also the case when, basically, the binder does not dissolve quickly in water at room temperature, for example because of a crystal structure. However, binders which, in a test as described above, can be almost completely dissolved in 90 seconds in a concentration of 8 g of binder to 1 liter of water at 30° C. are preferably used.

Accordingly, the binder(s) must be of the type which retain(s) its/their adhesive properties, even at temperatures well above the melting point or rather the softening point. On the other hand, it is also crucial to the choice of the binder(s) used in terms of type and quantity that, although the binding properties remain intact after recooling within the end product, so that the cohesion of the end product is ensured, the end product itself does not become tacky under standard storage and transportation conditions.

In the interests of simplicity, the binder will hereinafter be referred to solely as "a binder" or "the binder". However, it is emphasized that, basically, several different binders and mixtures of different binders may always be used.

One preferred embodiment of the invention is characterized by the use of a binder which is completely present as a melt at temperatures of up to at most 130° C., preferably at temperatures of up to at most 100° C. and more preferably at temperatures of up to 90° C. Accordingly, the binder should be selected according to the particular process and process conditions or, if it is desired to use a certain binder, the process conditions, particularly the process temperature, should be adapted to the binder.

Preferred binders which may be used either individually or in the form of mixtures with other binders are polyethylene glycols, 1,2-polypropylene glycols and modified polyethylene glycols and polypropylene glycols. The modified polyalkylene glycols include, in particular, the sulfates and/or the disulfates of polyethylene glycols or polypropylene glycols with a relative molecular weight of 600 to 12,000 and, more particularly, in the range from 1,000 to 4,000. Another group consists of mono- and/or disuccinates of polyalkylene glycols which, in turn, have relative molecular weights of 600 to 6,000 and, preferably, in the range from 1,000 to 4,000. A more detailed description of the modified polyalkylene glycol ethers can be found in the disclosure of International patent application WO-A-93/02176. In the context of the invention, polyethylene glycols include polymers which have been produced using $C_{3-5}$ glycols and also glycerol and mixtures thereof besides ethylene glycol as starting molecules. In addition, they also include ethoxylated derivatives, such as trimethylol propane containing 5 to 30 EO.

The polyethylene glycols preferably used may have a linear or branched structure, linear polyethylene glycols being particularly preferred.

Particularly preferred polyethylene glycols include those having relative molecular weights in the range from 2,000 to 12,000 and, advantageously, around 4,000. Polyethylene glycols with relative molecular weights below 3,500 and above 5,000 in particular may be used in combination with polyethylene glycols having a relative molecular weight of around 4,000. More than 50% by weight, based on the total quantity of polyethylene glycols, of such combinations may advantageously contain polyethylene glycols with a relative molecular weight of 3,500 to 5,000. However, polyethylene glycols which, basically, are present as liquids at room temperature/1 bar pressure, above all polyethylene glycol with a relative molecular weight of 200, 400 and 600, may also be used as binders. However, these basically liquid polyethylene glycols should only be used in the form of a mixture with at least one other binder, this mixture again having to satisfy the requirements according to the invention, i.e. must have a melting point or softening point at least above 45° C.

The modified polyethylene glycols also include polyethylene glycols end-capped on one or more sides, the end groups preferably being $C_{1-12}$ alkyl chains which may be linear or branched. In particular, the terminal groups have $C_{1-6}$ and, above all, $C_{1-4}$ alkyl chains, isopropyl and isobutyl or tert.butyl being other possible alternatives.

Polyethylene glycol derivatives end-capped on one side may also correspond to the formula $C_x(EO)_y(PO)_z$, where $C_x$ may be a $C_{1-20}$ alkyl chain, y may be a number of 50 to 500 and z may be a number of 0 to 20. Where z=0, the polyethylene glycol derivatives overlap with compounds corresponding to the preceding paragraph. However, EO-PO polymers (x=0) may also serve as binders.

Other suitable binders which may be used in water-free or substantially water-free press agglomeration processes are disclosed in earlier German patent application 196 38 599.7 and may also be used in accordance with the present invention.

According to the teaching of earlier German patent application 196 38 599.7, the content of binder(s) in the premix is preferably at least 2% by weight, but less than 15% by weight, preferably less than 10% by weight and more preferably from 3 to 6% by weight, based on the premix. The polymers swollen in the absence of water in particular are used in quantities below 10% by weight, advantageously in quantities of 4 to 8% by weight and preferably in quantities of 5 to 6% by weight. According to the invention, the minimum binder content of the premix may be further reduced by virtue of the use of perfume therein (see below).

In one preferred embodiment of the process according to the invention, the solids for producing the solid free-flowing premix are first mixed together in a standard mixer and/or granulator at room temperature to slightly elevated temperatures, which are preferably below the melting temperature or the softening point of the binder, more particularly at temperatures of up to 35° C.

The binders are preferably added as the last component. As mentioned above, they may be added as solids, i.e. at a processing temperature below their melting point or rather their softening point, or as a melt. However, they are advantageously added under such conditions that the binder is uniformly distributed in the mixture of solids. With very fine-particle binders, this can be done at temperatures below 40° C., for example at temperatures of the binder of 15 to 30° C. However, the binder preferably has temperatures at which it is already present in the form of a melt, i.e. above the softening point, more particularly in the form of a complete melt. Preferred melt temperatures are in the range from 60 to 150° C., melt temperatures in the range from 80 to 120° C. being particularly preferred. During the mixing process, which takes place at room temperature to slightly elevated temperature, but below the softening point or rather the melting point of the binder, the melt solidifies almost instantaneously and, according to the invention, the premix is present in solid free-flowing form. At all events, the mixing process is advantageously continued until the melt has solidified and the premix is present in solid, free-flowing form.

Through the incorporation of the perfume in the premix, the percentage content of binder(s) can be reduced. Since the perfumes act as lubricants and, by virtue of their uniform distribution throughout the press agglomerate, do not impede the redissolution process despite their generally hydrophobic character, it is possible further to reduce the binder content of the premix mentioned in earlier German patent application 196 38 599.7 (more than 2 to less than 15% by weight, preferably less than 10% by weight and more preferably 3 to 6% by weight), so that binder contents of 1 to 5% by weight and preferably 2 to 4% by weight may be used. Preferred processes are characterized by the use of a premix of which the binder content is at least 1% by weight, but less than 10% by weight, preferably less than 8% by weight and more preferably from 2 to 4% by weight, based on the premix. As the binder content decreases, larger quantities of nonionic surfactant can be incorporated so that it is possible by the process according to the invention to produce perfume-enhanced high-surfactant press agglomerates which could not be produced by existing methods. In this case, the premix preferably contains distinctly more than the minimum quantity of 0.1% by weight of perfume. Preferred processes according to the invention are characterized in that the premix contains more than 0.15% by weight, preferably more than 0.2% by weight and more preferably more than 0.3% by weight of perfume.

The perfume may be incorporated in the premix at virtually any stage of its production. For example, the solids may be completely or partly introduced into a standard mixer and/or granulator at room temperature, as described above, and the perfume may be added to or sprayed onto the moving bed of solids. However, the perfume may also be added to the solids together with the binder, as described above. In this case, perfume may be mixed with solid binder or the perfume may be incorporated in a separately prepared melt of the binder and the paste-like or liquid binder/perfume mixture may be added to the solids. Any of the methods of incorporation mentioned above may of course also be combined with one another, part of the perfume always being introduced into the premix in different ways. If nonionic surfactants are used in the process according to the invention, the perfume is preferably added in the form of a mixture with the nonionic surfactants, in which case mixtures of binder, nonionic surfactant and perfume may also be prepared and used.

The fact that the process is carried out in the substantial absence of water enables the perfume to be incorporated in the premix because there is no need for subsequent drying steps where perfume losses could occur. In addition, the fact that the process is carried out under these conditions has the advantage that peroxy bleaching agents can be processed without any losses of activity, in addition to which peroxy bleaching agents and bleach activators (for an exact description, see below) can be processed together without any danger of serious losses of activity.

The compacting of the pile of particles (premix) on the one hand reduces porosity in the press agglomeration process while, on the other hand, particle adhesion is strenghtened by the plastic deformation of the contact zones so that materials which largely lend themselves to plastic deformation give compactates of high strength while elastically deformable particles with brittle behavior are more difficult to compress. Compression behavior can be improved by the addition of binders. The press agglomeration process to which the solid and substantially water-free premix is subjected may be carried out in various agglomerators. Press agglomeration processes are classified according to the type of agglomerator used. The four most common press agglomeration processes—which are preferred to the purposes of the invention—are extrusion, roll compacting, pelleting and tabletting, so that preferred agglomeration processes for the purposes of the present invention are extrusion, roll compacting, pelleting and tabletting processes.

One feature common to all these processes is that the premix is compacted and plasticized under pressure and the individual particles are pressed against one another with a reduction in porosity and adhere to one another. In all the processes (but with certain limitations in the case of tabletting), the tools may be heated to relatively high temperatures or may be cooled to dissipate the heat generated by shear forces. The actual compacting process is preferably carried out at processing temperatures which, at least in the compacting step, at least correspond to the temperature of the softening point if not to the temperature of the melting point of the binder. In one preferred embodiment of the invention, the process temperature is significantly above the melting point or above the temperature at which the binder is present as a melt. In a particularly preferred embodiment, however, the process temperature in the compacting step is no more than 20° C. above the melting temperature or the upper limit to the melting range of the binder. Although, technically, it is quite possible to adjust even higher temperatures, it has been found that a temperature difference in relation to the melting temperature or to the softening temperature of the binder of 20° C. is generally quite sufficient and even higher temperatures do not afford additional advantages. Accordingly it is particularly preferred, above all on energy grounds, to carry out the compacting step above, but as close as possible to, the melting point or rather to the upper temperature limit of the melting range of the binder. Controlling the temperature in this way has the further advantage that even heat-sensitive raw materials, for example peroxy bleaching agents, such as perborate and/or percarbonate, and also enzymes, can be processed increasingly without serious losses of active substance. The possibility of carefully controlling the temperature of the binder, particularly in the crucial compacting step, i.e. between mixing/homogenizing of the premix and shaping, enables the process to be carried out very favorably in terms of energy consumption and with no damaging effects on the heat-sensitive constituents of the premix because the premix is only briefly exposed to the relatively high temperatures. In preferred press agglomeration processes, the working tools of the press agglomerator (the screw(s) of the extruder, the roller(s) of the roll compactor and the pressure roller(s) the pellet press) have a temperature of at most 150° C., preferably of at most 100° C. and, in a particularly preferred embodiment, at most 75° C., the process temperature being 30° C. and, in a particularly preferred embodiment, at most 20° C. above the melting temperature or rather the upper temperature limit to the melting range of the binder. The heat exposure time in the compression zone of the press agglomerators is preferably at most 2 minutes and, more preferably, between 30 seconds and 1 minute.

The temperature of the compacted material immediately after leaving the production unit is preferably not more than 90° C. and, in one particularly preferred embodiment, is between 35 and 85° C. It has been found that exit temperatures, above all in the extrusion process, of 40 to 80° C., for example up to 70° C., are particularly advantageous.

In one preferred embodiment of the invention, the process according to the invention is carried out by extrusion as described, for example in European patent EP-B-0 486 592 (Henkel KGBA) or International patent applications WO-A-93/02176 (Henkel KGaA) and WO-A-94/09111 (Henkel KGaA). In this extrusion process, a solid premix is extruded under pressure to form a strand and, after emerging from the multiple-bore extrusion die, the strands are cut into granules of predetermined size by means of a cutting unit. The solid, homogeneous premix contains a plasticizer and/or lubricant of which the effect is to soften the premix under the pressure applied or under the effect of specific energy, so that it can be extruded. Preferred plasticizers and/or lubricants are surfactants and/or polymers which, except for the nonionic surfactants mentioned above, are introduced into the premix in solid form, but not in liquid form and especially not in the form of an aqueous liquid in accordance with the present invention.

Particulars of the actual extrusion process can be found in the above-cited patents and patent applications to which reference is hereby expressly made. In one preferred embodiment of the invention, the premix is delivered, preferably continuously, to a planetary roll extruder or to a twin-screw extruder with co-rotating or contra-rotating screws, of which the barrel and the extrusion/granulation head can be heated to the predetermined extrusion temperature. Under the shear effect of the extruder screws, the premix is compacted under a pressure of preferably at least 25 bar or—with extremely high throughputs—even lower, depending on the apparatus used, plasticized, extruded in the form of fine strands through the multiple-bore extrusion die in the extruder head and, finally, size-reduced by means of a rotating cutting blade, preferably into spherical or cylindrical granules. The bore diameter of the multiple-bore extrusion die and the length to which the strands are cut are adapted to the selected granule size. In this embodiment, granules are produced in a substantially uniformly predeterminable particle size, the absolute particle sizes being adaptable to the particular application envisaged. In general, particle diameters of up to at most 0.8 cm are preferred. Important embodiments provide for the production of uniform granules in the millimeter range, for example in the range from 0.5 to 5 mm and more particularly in the range from about 0.8 to 3 mm. In one important embodiment, the length-to-diameter ratio of the primary granules is in the range from about 1:1 to about 3:1. In another preferred embodiment, the still plastic primary granules are subjected to another shaping process step in which edges present on the crude extrudate are rounded off so that, ultimately, spherical or substantially spherical extrudate granules can be obtained. If desired, small quantities of drying powder, for example zeolite powder, such as zeolite NaA powder, may be used in this step. This shaping step may be carried out in commercially available spheronizers. It is important in this regard to ensure that only small quantities of fines are formed in this stage. According to the present invention, however, there is no need for drying, which is described as a preferred embodiment in the prior art documents cited above, because the process according to the invention is carried out in the substantial absence of water, i.e. without the addition of free non-bound water.

Alternatively, extrusion/compression steps may also be carried out in low-pressure extruders, in a Kahl press (Amandus Kahl) or in a so-called Bextruder.

In one particularly preferred embodiment of the invention, the temperature prevailing in the transition section of the screw, the pre-distributor and the extrusion die is controlled in such a way that the melting temperature of the binder or rather the upper limit to the melting range of the binder is at least reached and preferably exceeded. The temperature exposure time in the compression section of the extruder is preferably less than 2 minutes and, more particularly, between 30 seconds and 1 minute.

The brief residence times together with the absence of water enable peroxy bleaching agents, optionally in conjunction with bleach activators, to be extruded even at relatively high temperatures without suffering serious losses of activity.

In one particularly advantageous embodiment of the invention, the binder used has a melting temperature or a melting range of up to 75° C. In this embodiment, process temperatures at most 10° C. and, more particularly, at most 5° C. above the melting temperature or rather the upper temperature limit of the melting range of the binder have proved to be particularly favorable.

Under these process conditions, the binder—in addition to its functions as mentioned hitherto—also acts as a lubricant and prevents or at least reduces the formation of sticky deposits on machine walls and compacting tools. This applies not only to extrusion but equally, for example, to processing in continuous mixers/granulators or rolls.

As in the extrusion process, it is also preferred in the other production processes to subject the primary granules/compactates formed to another shaping process step, more particularly spheronizing, so that, ultimately, spherical or substantially spherical (bead-like) granules can be obtained. A key feature of another preferred embodiment of the invention is that the particle size distribution of the premix is considerably broader than that of the end product according to the invention/produced in accordance with the invention. The premix may have much larger fine-particle components, even dust-fine components and may optionally contain larger numbers of relatively coarse particles, although a premix with a relatively broad particle size distribution and with relatively high percentages of fine particles is preferably converted into an end product with a relatively narrow particle size distribution and relatively small numbers of fines.

By virtue of the fact that the process according to the invention is carried out in the substantial absence of water, i.e. except for the water present as "impurity" in the solid raw materials used, not only is the danger of gelation of the surface-active raw materials in the production process itself minimized or ruled out altogether, an ecologically valuable process is also provided because elimination of the need for a subsequent drying step not only saves energy, emissions which occur predominantly in conventional drying techniques can also be avoided. In addition, the absence of subsequent drying steps enables the perfumes to be incorporated in the premix and thus provides for the production of perfume-enhanced detergents or detergent components.

In another preferred embodiment of the present invention, the process according to the invention is carried out by roll compacting. In this variant, the perfume-containing, solid and substantially water-free premix is introduced between two rollers—either smooth or provided with depressions of defined shape—and rolled under pressure between the two rollers to form a sheet-like compactate. The rollers exert a high linear pressure on the premix and may be additionally heated or cooled as required. Where smooth rollers are used, smooth untextured compactate sheets are obtained. By contrast, where textured rollers are used, correspondingly textured compactates, in which for example certain shapes can be imposed in advance on the subsequent detergent particles, can be produced. The sheet-like compactate is then broken up into smaller pieces by a chopping and size-reducing process and can thus be processed to granules which can be further refined and, more particularly, converted into a substantially spherical shape by further surface treatment processes known per se.

In roll compacting, too, the temperature of the pressing tools, i.e. the rollers, is preferably at most 150° C., more preferably at most 100° C. and most preferably at most 75° C. Particularly preferred production processes based on roll compacting are carried out at temperatures 10° C. and, in particular, at most 5° C. above the melting temperature of the binder or the upper temperature limit of the melting range of the binder. The temperature exposure time in the compression section of the rollers—either smooth or provided with depressions of defined shape—is preferably at most 2 minutes and, more particularly, between 30 seconds and 1 minute.

In another preferred embodiment of the present invention, the process according to the invention is carried out by pelleting. In this process, the perfume-containing, solid and substantially water-free premix is applied to a perforated surface and is forced through the perforations and at the same time plasticized by a pressure roller. In conventional pellet presses, the premix is compacted under pressure, plasticized, forced through a perforated surface in the form of fine strands by means of a rotating roller and, finally, is size-reduced to granules by a cutting unit. The pressure roller and the perforated die may assume many different forms. For example, flat perforated plates are used, as are concave or convex ring dies through which the material is pressed by one or more pressure rollers. In perforated-plate presses, the pressure rollers may also be conical in shape. In ring die presses, the dies and pressure rollers may rotate in the same direction or in opposite directions. A press suitable for carrying out the process according to the invention is described, for example, in DE-OS 38 16 842 (Schlüter GmbH). The ring die press disclosed in this document consists of a rotating ring die permeated by pressure bores and at least one pressure roller operatively connected to the inner surface thereof which presses the material delivered to the die space through the pressure bores into a discharge unit. The ring die and pressure roller are designed to be driven in the same direction which reduces the shear load applied to the premix and hence the increase in temperature which it undergoes. However, the pelleting process may of course also be carried out with heatable or coolable rollers to enable the premix to be adjusted to a required temperature.

In pelleting, too, the temperature of the pressing tools, i.e. the pressure rollers, is preferably at most 150° C., more preferably at most 100° C. and most preferably at most 75° C. Particularly preferred production processes based on pelleting are carried out at temperatures 10° C. and, in particular, at most 5° C. above the melting temperature of the binder or the upper temperature limit of the melting range of the binder.

Another press agglomeration process which may be used in accordance with the invention is tabletting. In view of the size of the tablets produced, it may be appropriate in the tabletting variant to add conventional disintegration aids, for example cellulose and cellulose derivatives, more particularly in a coarse form, or crosslinked PVP, in addition to the binder described above to facilitate the disintegration of the tablets in the wash liquor.

In one preferred embodiment, the invention provides a perfume-enhanced, extruded, roll-compacted or pelleted detergent of which at least 80% by weight consists of compounds produced in accordance with the invention and/or treated raw materials. More particularly, at least 80% by weight of an extruded, roll-compacted or pelleted detergent consists of a basic agglomerate produced in accordance with the invention. The remaining constituents may have been produced and incorporated by any known process. Preferably, however, these remaining constituents also—which may be compounds and/or treated raw materials—will have been produced by the process according to the invention. Above all, this enables the basic granules and remaining constituents to be produced with substantially the flow behavior, bulk density, size and particle size distribution.

The particulate press agglomerates obtained may either be directly used as detergents or may be aftertreated and/or compounded beforehand by conventional methods. Conventional aftertreatments include, for example, powdering with fine-particle detergent ingredients which, in general, produces a further increase in bulk density. However, another preferred aftertreatment is the procedure according to German patent applications DE-A-195 24 287 and DE-A-195 47 457, according to which dust-like or at least fine-particle ingredients (so-called fine components) are bonded to the particulate end products produced by the process according to the invention which serve as core. This results in the formation of detergents which contain these so-called fine components as an outer shell. Advantageously, this is again done by melt agglomeration using the same binders as in the process according to the invention. On the subject of the melt agglomeration of fine components onto the basic granules according to the invention and produced in accordance with the invention, reference is specifically made to the disclosure of German patent applications DE-A-195 24 287 and DE-A-195 47 457.

Both the perfume-enhanced detergents, of which at least 80% by weight consist of press agglomerates produced in accordance with the invention, and the press agglomerates themselves may be additionally sprayed with perfume in a subsequent step. The conventional perfuming variant, i.e. powdering and spraying with perfume, can also be carried out with the press agglomerates according to the invention.

Advantageously, at least 30% by weight, preferably at least 40% by weight and more preferably at least 50% by weight of the total perfume present in the perfume-enhanced detergents according to the invention are introduced into the detergent by the production process according to the invention, i.e. incorporated in the press agglomerates, while the remaining 70% by weight, preferably 60% by weight and more preferably 50% by weight of the total perfume present may be sprayed onto or otherwise applied to the press agglomerates which may optionally be surface-treated.

By dividing the total perfume content of the detergents into perfume present in the press agglomerates and perfume adhering to the press agglomerates, it is possible to achieve a number of product features which are only possible through the process according to the invention. For example, the total perfume content of the detergents can be divided into two portions x and y, portion x consisting of firmly adhering perfume oils, i.e. less volatile perfume oils, and portion y consisting of more volatile perfume oils.

Now, it is possible to produce detergents where the percentage of perfume introduced into the detergent through the press agglomerates is mainly made up of firmly adhering perfumes. In this way, firmly adhering perfumes which are intended to perfume the treated articles, more especially textiles, are "retained" in the product and thus develop their effect primarily on the treated laundry. By contrast, the more readily volatile perfumes contribute towards more intensive perfuming of the detergents per se. In this way, it is also possible to produce detergents which, as detergents, have a perfume that differs from the perfume of the treated articles. There are virtually no limits in this regard to the creativity of perfumists because almost limitless possibilities for perfuming the detergents and—through the detergents—the articles treated with them exist on the one hand through the choice of the perfumes and on the other hand through the choice of the method used to incorporate them in the detergents.

The principle described above can of course also be reversed by incorporating the more readily volatile perfumes in the press agglomerates and spraying the less volatile firmly adhering perfumes onto the detergents. In this way, the loss of the more readily volatile perfumes from the pack in storage and in transit is minimized while the perfume characteristic of the detergents is determined by the more firmly adhering perfumes.

The general description of the perfumes suitable for use in accordance with the invention (see above) represented the various classes of perfumes in general terms. In order to be noticeable, a perfume has to be volatile, its molecular weight being an important factor along with the nature of the functional groups and the structure of the chemical compound. Thus, most perfumes have molecular weights of up to about 200 dalton, molecular weights of 300 dalton and higher being more the exception. In view of the differences in volatility of perfumes, the odor of a perfume or fragrance composed of several perfumes changes during the evaporation process, the odor impressions being divided into the top note, the middle note or body and the end note or dry out. Since odor perception is also based to a large extent on odor intensity, the top note of a perfume or fragrance does not consist solely of readily volatile compounds whereas the end note or dry out consists largely of less volatile, i.e. firmly adhering, perfumes. In the composition of perfumes, more readily volatile perfumes may be fixed, for example, to certain "fixatives", which prevents them from vaporizing too rapidly. The above-described embodiment of the present invention, in which the more readily volatile perfumes or fragrances are incorporated in the press agglomerate, is one such method of fixing a perfume. Accordingly, in the following classification of perfumes into "readily volatile" and "firmly adhering" perfumes, nothing is said about the odor impression or about whether the corresponding perfume is perceived as a top note or middle note.

Firmly adhering perfumes suitable for use in accordance with the present invention are, for example, the essential oils, such as angelica root oil, aniseed oil, amica flowers oil, basil oil, bay oil, bergamot oil, champax blossom oil, silver fir oil, silver fir cone oil, elemi oil, eucalyptus oil, fennel oil, pine needle oil, galbanum oil, geranium oil, ginger grass oil, guaiac wood oil, Indian wood oil, helichrysum oil, ho oil, ginger oil, iris oil, cajeput oil, sweet flag oil, camomile oil, camphor oil, canaga oil, cardamom oil, cassia oil, Scotch fir oil, copaiba balsam oil, coriander oil, spearmint oil, caraway oil, cumin oil, lavender oil, lemon grass oil, limette oil, mandarin oil, melissa oil, amber seed oil, myrrh oil, clove oil, neroli oil, niaouli oil, olibanum oil, orange oil, origanum oil, palmarosa oil, patchouli oil, Peru balsam oil, petit grain oil, pepper oil, peppermint oil, pimento oil, pine oil, rose oil, rosemary oil, sandalwood oil, celery seed oil, lavender spike oil, Japanese anise oil, turpentine oil, thuja oil, thyme oil, verbena oil, vetiver oil, juniper berry oil, wormwood oil, wintergreen oil, ylang-ylang oil, ysop oil, cinnamon oil, cinnamon leaf oil, citronella oil, citrus oil and cypress oil.

However, relatively high-boiling or solid perfumes of natural or synthetic origin may also be used in accordance with the invention as firmly adhering perfumes or perfume mixtures. These compounds include those mentioned in the following and mixtures thereof: ambrettolide, α-amyl cinnamaldehyde, anethole, anisaldehyde, anisalcohol, anisole, methyl anthranilate, acetophenone, benzyl acetone, benzaldehyde, ethyl benzoate, benzophenone, benzyl alcohol, benzyl acetate, benzyl benzoate, benzyl formate, benzyl valerate, bomeol, bomyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formiate, heliotropin, methyl heptyne carboxylate, heptaldehyde, hydroquinone dimethyl ether, hydroxycinnamaldehyde, hydroxycinnamyl alcohol, indole, irone, isoeugenol, isoeugenol methyl ether, isosafrol, jasmone, camphor, carvacrol, carvone, p-cresol methyl ether, coumarin, p-methoxyacetophenone, methyl-n-amyl ketone, methyl anthranilic acid methyl ester, p-methyl acetophenone, methyl chavicol, p-methyl quinoline, methyl-β-naphthyl ketone, methyl-n-nonyl acetaldehyde, methyl-n-nonyl ketone, muskone, β-naphthol ethyl ether, β-naphthol methyl ether, nerol, nitrobenzene, n-nonyl aldehyde, nonyl alcohol, n-octyl aldehyde, p-oxyacetophenone, pentadecanolide, β-phenyl ethyl alcohol, phenyl acetaldehyde dimethyl acetal, phenyl acetic acid, pulegone, safrol, isoamyl salicylate, methyl salicylate, hexyl salicylate, cyclohexyl salicylate, santalol, scatol, terpineol, thymene, thymol, γ-undecalactone, vanillin, veratrum aldehyde, cinnamaldehyde, cinnamyl alcohol, cinnamic acid, ethyl cinnamate, benzyl cinnamate.

The more readily volatile perfumes include, in particular, the relatively low-boiling perfumes of natural or synthetic origin which may be used either individually or in the form of mixtures. Examples of more readily volatile perfumes are alkyl isothiocyanates (alkyl mustard oils), butanedione, limonene, linalool, linalyl acetate and propionate, menthol, menthone, methyl-n-heptenone, phellandrene, phenyl acetaldehyde, terpinyl acetate, citral, citronellal.

The possible other ingredients of the detergents according to the invention and the components used in the process according to the invention are described in detail in the following.

Important ingredients of the detergents according to the invention and ingredients which are used in the process according to the invention are surfactants, particularly anionic surfactants, which should be present in the detergents according to the invention or in detergents produced in accordance with the invention in quantities of at least 0.5% by weight. Anionic surfactants include, in particular, sulfonates and sulfates and also soaps.

Preferred surfactants of the sulfonate type are preferably $C_{9-13}$ alkyl benzenesulfonates, olefin sulfonates, i.e. mixtures of alkene and hydroxy-alkane sulfonates, and the disulfonates obtained, for example, from $C_{12-18}$ monoolefins with an internal or terminal double bond by sulfonation with gaseous sulfur trioxide and subsequent alkaline or acidic hydrolysis of the sulfonation products.

Other suitable surfactants of the sulfonate type are the alkane sulfonates obtained from $C_{12-18}$ alkanes, for example by sulfochlorination or sulfoxidation and subsequent hydrolysis or neutralization.

The esters of α-sulfofatty acids (ester sulfonates), for example the α-sulfonated methyl esters of hydrogenated coconut oil, palm kernel oil or tallow fatty acids, which are obtained by α-sulfonation of the methyl esters of fatty acids of vegetable and/or animal origin containing 8 to 20 carbon atoms in the fatty acid molecule and subsequent neutralization to water-soluble monosalts are also suitable. The esters in question are preferably the α-sulfonated esters of hydrogenated coconut acid, palm oil acid, palm kernel oil acid or tallow acid, although sulfonation products of unsaturated fatty acids, for example oleic acid, may also be present in small quantities, preferably in quantities of not more than about 2 to 3% by weight. α-Sulfofatty acid alkyl esters with an alkyl chain of not more than 4 carbon atoms in the ester group, for example methyl esters, ethyl esters, propyl esters and butyl esters, are particularly preferred. The methyl esters of α-sulfofatty acids (MES) and saponified disalts thereof are used with particular advantage.

Other suitable anionic surfactants are sulfonated fatty acid glycerol esters, i.e. the monoesters, diesters and triesters and mixtures thereof which are obtained where production is carried out by esterification by a monoglycerol with 1 to 3 moles of fatty acid or in the transesterification of triglycerides with 0.3 to 2 moles of glycerol.

Preferred alk(en)yl sulfates are the alkali metal salts and, in particular, the sodium salts of the sulfuric acid semiesters of $C_{12-18}$ fatty alcohols, for example coconut alcohol, tallow alcohol, lauryl, myristyl, cetyl or stearyl alcohol, or $C_{10-20}$ oxoalcohols and the corresponding semiesters of secondary alcohols with the same chain length. Other preferred alk(en)yl sulfates are those with the chain length mentioned which contain a synthetic, linear alkyl chain based on a petrochemical and which are similar in their degradation behavior to the corresponding compounds based on oleochemical raw materials. $C_{12-16}$ alkyl sulfates and $C_{12-15}$ alkyl sulfates and also $C_{14-15}$ alkyl sulfates are particularly preferred from the washing performance point of view. Other suitable anionic surfactants are 2,3-alkyl sulfates which may be produced, for example, in accordance with U.S. Pat. No. 3,234,258 or U.S. Pat. No. 5,075,041 and which are commercially obtainable as products of the Shell Oil Company under the name of DAN®.

The sulfuric acid monoesters of linear or branched $C_{7-21}$ alcohols ethoxylated with 1 to 6 moles of ethylene oxide, such as 2-methyl-branched $C_{9-11}$ alcohols containing on average 3.5 moles of ethylene oxide (EO) or $C_{12-18}$ fatty alcohols containing 1 to 4 EO, are also suitable. In view of their high foaming capacity, they are only used in relatively small quantities, for example in quantities of 1 to 5% by weight, in laundry detergents.

Other preferred anionic surfactants are the salts of alkyl sulfosuccinic acid which are also known as sulfosuccinates or as sulfosuccinic acid esters and which represent monoesters and/or diesters of sulfosuccinic acid with alcohols, preferably fatty alcohols and, more particularly, ethoxylated fatty alcohols. Preferred sulfosuccinates contain $C_{8-18}$ fatty alcohol molecules or mixtures thereof. Particularly preferred sulfosuccinates contain a fatty alcohol molecule derived from ethoxylated fatty alcohols which, considered in isolation, represent nonionic surfactants (for a description, see below). Of these sulfosuccinates, those of which the fatty alcohol molecules are derived from narrow-range ethoxylated fatty alcohols are particularly preferred. Alk(en)yl succinic acid preferably containing 8 to 18 carbon atoms in the alk(en)yl chain or salts thereof may also be used.

Other suitable anionic surfactants are fatty acid derivatives of amino acids, for example of N-methyl taurine (taurides) and/or of N-methyl glycine (sarcosides). The sarcosides or rather sarcosinates, above all sarcosinates of higher and optionally mono- or poly-unsaturated fatty acids, such as oleyl sarcosinate, are particularly preferred.

Other suitable anionic surfactants are, in particular, soaps which are preferably used in quantities of 0.2 to 5% by weight. Suitable soaps are, in particular, saturated fatty acid soaps, such as the salts of lauric acid, myristic acid, palmitic acid, stearic acid, hydrogenated erucic acid and behenic acid, and soap mixtures derived in particular from natural fatty acids, for example coconut oil, palm kernel oil or tallow acids. The known alkenylsuccinic acid salts may also be used together with these soaps or as a substitute for soaps.

The anionic surfactants (and soaps) may be present in the form of their sodium, potassium or ammonium salts and as soluble salts of organic bases, such as mono-, di- or triethanolamine. The anionic surfactants are preferably present in the form of their sodium or potassium salts and, more preferably, in the form of their sodium salts.

The anionic surfactants are present in the detergents according to the invention and used in the process according to the invention in quantities of preferably 1 to 30% by weight and, more preferably, 5 to 25% by weight.

Besides anionic surfactants and cationic, zwitterionic and amphoteric surfactants, nonionic surfactants above all are preferred.

Preferred nonionic surfactants are alkoxylated, advantageously ethoxylated, more particularly primary alcohols preferably containing 8 to 18 carbon atoms and an average of 1 to 12 moles of ethylene oxide (EO) per mole of alcohol, in which the alcohol group may be linear or, preferably, 2-methyl-branched or may contain linear and methyl-branched radicals in the form of the mixtures typically present in oxoalcohol groups. However, alcohol ethoxylates containing linear residues of alcohols of native origin with 12 to 18 carbon atoms, for example coconut oil fatty alcohol, palm oil fatty alcohol, tallow fatty alcohol or oleyl alcohol, and an average of 2 to 8 EO per mole of alcohol are particularly preferred. Preferred ethoxylated alcohols include, for example, $C_{12-14}$ alcohols containing 3 EO or 4 EO, $C_{9-11}$ alcohols containing 7 EO, $C_{13-15}$ alcohols containing 3 EO, 5 EO, 7 EO or 8 EO, $C_{12-18}$ alcohols containing 3 EO, 5 EO or 7 EO and mixtures thereof, such as mixtures of $C_{12-14}$ alcohol containing 3 EO and $C_{12-18}$ alcohol containing 7 EO. The degrees of ethoxylation mentioned are statistical mean values which, for a special product, may be either a whole number or a broken number. Preferred alcohol ethoxylates have a narrow homolog distribution (narrow range ethoxylates, NRE). In addition to these nonionic surfactants, fatty alcohols containing more than 12 EO may also be used, as described above. Examples of such fatty alcohols are (tallow) fatty alcohols containing 14 EO, 16 EO, 20EO, 25 EO, 30 EO or 40 EO.

The nonionic surfactants also include alkyl glycosides with the general formula $RO(G)_x$ where R is a primary, linear or methyl-branched, more particularly 2-methyl-branched, aliphatic radical containing 8 to 22 and preferably 12 to 18 carbon atoms and G is a glycose unit containing 5 or 6 carbon atoms, preferably glucose. The degree of oligomerization x, which indicates the distribution of monoglycosides and oligoglycosides, is a number—which as an analytically determined quantity may even be a broken number—of 1 to 10 and preferably a number of 1.2 to 1.4.

Other suitable surfactants are polyhydroxyfatty acid amides corresponding to formula (I):

(I)

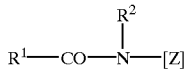

in which $R^1CO$ is an aliphatic acyl grouop containing 6 to 22 carbon atoms, $R^2$ is hydrogen, an alkyl or hydroxyalkyl group containing 1 to 4 carbon atoms and [Z] is a linear or branched polyhydroxyalkyl group containing 3 to 10 carbon atoms and 3 to 10 hydroxyl groups. The polyhydroxyfatty acid amides are preferably derived from reducing sugars containing 5 or 6 carbon atoms, more particularly from glucose.

The group of polyhydroxyfatty acid amides also includes compounds corresponding to formula (II):

(II)

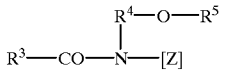

in which $R^3$ is a linear or branched alkyl or alkenyl group containing 7 to 12 carbon atoms, $R^4$ is a linear, branched or cyclic alkyl group or an aryl group containing 2 to 8 carbon atoms and $R^5$ is a linear, branched or cyclic alkyl group or an aryl group or a hydroxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxyl groups, or alkoxylated, preferably ethoxylated or propoxylated, derivatives of such a group. Again, [Z] is preferably obtained by reductive amination of a sugar, for example glucose, fructose, maltose, lactose, galactose, mannose or xylose. The N-alkoxy or N-aryloxy-substituted compounds may then be converted into the required polyhydroxyfatty acid amides by reaction with fatty acid methyl esters in the presence of an alkoxide as catalyst, for example in accordance with the teaching of International patent application WO-A-95/07331.

Another class of preferred nonionic surfactants which are used either as sole nonionic surfactant or in combination with other nonionic surfactants, particularly together with alkoxylated fatty alcohols and/or alkyl glycosides, are alkoxylated, preferably ethoxylated or ethoxylated and propoxylated, fatty acid alkyl esters preferably containing 1 to 4 carbon atoms in the alkyl chain, more particularly the fatty acid methyl esters which are described, for example, in Japanese patent application JP 58/217598 or which are preferably produced by the process described in International patent application WO-A-90/13533. $C_{12-18}$ fatty acid methyl esters containing on average 3 to 15 EO and, more particularly, 5 to 12 EO are preferred as nonionic surfactants whereas fatty acid methyl esters with a relatively high degree of ethoxylation above all are advantageous as binders, as described above. $C_{12-18}$ fatty acid methyl esters containing 10 to 12 EO may be used both as surfactants and as binders.

Nonionic surfactants of the amine oxide type, for example N-coconutalkyl-N,N-dimethylamine oxide and N-tallowalkyl-N,N-dihydroxy-ethyl amine oxide, and the fatty acid alkanolamide type are also suitable. The quantity in which these nonionic surfactants are used is preferably no more, in particular no more than half, the quantity of ethoxylated fatty alcohols used.

Other suitable surfactants are so-called gemini surfactants. Gemini surfactants are generally understood to be compounds which contain two hydrophilic groups and two hydrophobic groups per molecule. These groups are generally separated from one another by a so-called "spacer". The spacer is generally a carbon chain which should be long enough for the hydrophilic groups to have a sufficient spacing to be able to act independently of one another. Gemini surfactants are generally distinguished by an unusually low critical micelle concentration and by an ability to reduce the surface tension of water to a considerable extent. In exceptional cases, however, gemini surfactants are not only understood to be dimeric surfactants, but also trimeric surfactants.

Suitable gemini surfactants are, for example, the sulfated hydroxy mixed ethers according to German patent application DE-A-43 21 022 and the dimer alcohol bis- and trimer alcohol tris-sulfates and -ether sulfates according to German patent application DE 195 03 061. The end-capped dimeric and trimeric mixed ethers according to German patent application DE 195 13 391 are distinguished in particular by their bifunctionality and multifunctionality. Thus, the end-capped surfactants mentioned exhibit good wetting properties and are low-foaming so that they are particularly suitable for use in machine washing or dishwashing processes.

However, the gemini polyhydroxyfatty amides or poly-polyhydroxy-fatty acid amides described in International patent applications WO-A-95/19953, WO-A-95/19954 and WO-A-95/19955 may also be used.

Apart from surfactants, inorganic and organic builders above all are among the most important ingredients of detergents.

The finely crystalline, synthetic zeolite containing bound water used in accordance with the invention is preferably zeolite A and/or zeolite P. Zeolite MAP® (Crosfield), for example, is used as zeolite P. However, zeolite X and mixtures of A, X and/or P are also suitable. The zeolite may be used in the form of a spray-dried powder or even in the form of an undried stabilized suspension still moist from its production. Where the zeolite is used in the form of a suspension, the suspension may contain small additions of nonionic surfactants as stabilizers, for example 1 to 3% by weight, based on zeolite, of ethoxylated $C_{12-18}$ fatty alcohols containing 2 to 5 ethylene oxide groups, $C_{12-14}$ fatty alcohols containing 4 to 5 ethylene oxide groups or ethoxylated isotridecanols. Suitable zeolites have a mean particle size of less than 10 $\mu$m (volume distribution, as measured by the Coulter Counter Method) and contain preferably 18 to 22% by weight and more preferably 20 to 22% by weight of bound water.

Suitable substitutes or partial substitutes for phosphates and zeolites are crystalline layer-form sodium silicates corresponding to the general formula $NaMSi_xO_{2x+1}.yH_2O$, where M is sodium or hydrogen, x is a number of 1.9 to 4 and y is a number of 0 to 20, preferred values for x being 2, 3 or 4. Crystalline layer silicates such as these are described, for example, in European patent application EP-A-0 164 514. Preferred crystalline layer silicates corresponding to the above formula are those in which M is sodium and x assumes the value 2 or 3. Both β- and δ-sodium disilicates—$Na_2Si_2O_5.yH_2O$ are particularly preferred.

Other preferred builders are amorphous sodium silicates with a modulus ($Na_2O:SiO_2$ ratio) of 1:2 to 1:3.3, preferably 1:2 to 1:2.8 and more preferably 1:2 to 1:2.6 which dissolve with delay and exhibit multiple wash cycle properties. The delay in dissolution in relation to conventional amorphous sodium silicates can have been obtained in various ways, for example by surface treatment, compounding, compacting or by overdrying. In the context of the invention, the term "amorphous" is also understood to encompass "X-ray amorphous". In other words, the silicates do not produce any of the sharp X-ray reflexes typical of crystalline substances in X-ray diffraction experiments, but at best one or more maxima of the scattered X-radiation which have a width of several degrees of the diffraction angle. Particularly good builder properties may even be achieved where the silicate particles produce crooked or even sharp diffraction maxima in electron diffraction experiments. This may be interpreted to mean that the products have microcrystalline regions between 10 and a few hundred nm in size, values of up to at most 50 nm and, more particularly, up to at most 20 nm being preferred. So-called X-ray amorphous silicates such as these, which also dissolve with delay in relation to conventional waterglasses, are described for example in German patent application DE-A-44 00 024. Compacted amorphous silicates, compounded amorphous silicates and overdried X-ray-amorphous silicates are particularly preferred.

The generally known phosphates may of course also be used as builders providing their use is not ecologically problematical. The sodium salts of orthophosphates, pyrophosphates and, in particular, tripoly-phosphates are particularly suitable. Their content is generally no more than 25% by weight and preferably no more than 20% by weight, based on the final detergent. In some cases, it has been found that tri-polyphosphates in particular, even in small quantities of up to at most 10% by weight, based on the final detergent, produce a synergistic improvement in multiple wash cycle performance in combination with other builders.

Suitable substitutes or partial substitutes for the zeolite are layer silicates of natural and synthetic origin. Such layer silicates are known, for example, from patent application DE-B-23 34 899, EP-A- 0 026 529 and DE-A-35 26 405. Their suitability is not confined to a particular composition or structural formula. However, smectites, especially bentonites, are preferred.

Suitable layer silicates which belong to the group of water-swellable smectites are, for example, montmorillonite, hectorite or saponite. In addition, small quantities of iron may be incorporated in the crystal lattice of the layer silicates in accordance with the above formulae. By virtue of their ion-exchanging properties, the layer silicates may additionally contain hydrogen, alkali metal, alkaline earth metal ions, more particularly $Na^+$ and $Ca^{++}$. The water of hydration content is generally between 8 and 20% by weight, depending on the degree of swelling and the processing technique. Useful layer silicates are known, for example, from U.S. Pat. No. 3,966,629, EP-A-0 026 529 and EP-A-0 028 432. Layer silicates substantially freed from calcium ions and strongly coloring iron ions by an alkali treatment are preferably used.

Useful organic builders are, for example, polycarboxylic acids usable in the form of their sodium salts, such as citric acid, adipic acid, succinic acid, glutaric acid, tartaric acid, sugar acids, aminocarboxylic acids, nitrilotriacetic acid (NTA), providing their use is not ecologically unsafe, and mixtures thereof. Preferred salts are the salts of the polycarboxylic acids, such as citric acid, adipic acid, succinic acid, glutaric acid, tartaric acid, sugar acids and mixtures thereof.

The acids per se may also be used. Besides their builder effect, the acids also typically have the property of an acidifying component and, hence, also serve to establish a relatively low and mild pH value in detergents. Citric acid, succinic acid, glutaric acid, adipic acid, gluconic acid and mixtures thereof are particularly mentioned in this regard. If they are used in the premix according to the invention and are not subsequently added, these acids are preferably used in water-free form.

Other suitable organic builders are dextrins, for example oligomers or polymers of carbohydrates which may be obtained by partial hydrolysis of starches. The hydrolysis may be carried out by standard methods, for example acid- or enzyme-catalyzed methods. The end products are preferably hydrolysis products with average molecular weights of 400 to 500,000. A polysaccharide with a dextrose equivalent (DE) of 0.5 to 40 and, more particularly, 2 to 30 is preferred, the DE being an accepted measure of the reducing effect of a polysaccharide by comparison with dextrose which has a DE of 100. Both maltodextrins with a DE of 3 to 20 and dry glucose sirups with a DE of 20 to 37 and also so-called yellow dextrins and white dextrins with relatively high molecular weights of 2,000 to 30,000 may be used. A preferred dextrin is described in British patent application 94 19 091. The oxidized derivatives of such dextrins are their reaction products with oxidizing agents which are capable of oxidizing at least one alcohol function of the saccharide ring to the carboxylic acid function. Dextrins thus oxidized and processes for their production are known, for example, from European patent applications EP-A-0 232 202, EP-A-0 427 349, EP-A-0 472 042 and EP-A-0 542 496 and from International patent applications WO-A-92/18542, WO-A-93/08251, WO-A-94/28030, WO-A-95/07303, WO-A-95/12619 and WO-A-95/20608. A product oxidized at $C_6$ of the saccharide ring can be particularly advantageous.

Other suitable co-builders are oxydisuccinates and other derivatives of disuccinates, preferably ethylenediamine disuccinate. The glycerol disuccinates and glycerol trisuccinates described, for example, in U.S. Pat. No. 4,524,009 in U.S. Pat. No. 4,639,325, in European patent application EP-A-0 150 930 and in Japanese patent application JP 93/339896 are also particularly preferred in this connection. The quantities used in zeolite-containing and/or silicate-containing formulations are from 3 to 15% by weight.

Other useful organic co-builders are, for example, acetylated hydroxycarboxylic acids and salts thereof which may optionally be present in lactone form and which contain at least 4 carbon atoms, at least one hydroxy group and at most two acid groups. Co-builders such as these are described, for example, in International patent application WO-A-95/20029.

Suitable polymeric polycarboxylates are, for example, the sodium salts of polyacrylic acid or polymethacrylic acid, for example those with a relative molecular weight of 800 to 150,000 (based on acid). Suitable copolymeric polycarboxylates are, in particular, those of acrylic acid with methacrylic acid and of acrylic acid or methacrylic acid with maleic acid. Acrylic acid/maleic acid copolymers containing 50 to 90% by weight of acrylic acid and 50 to 10% by weight of maleic acid have proved to be particularly suitable. Their relative molecular weight, based on free acids, is generally in the range from 5,000 to 200,000, preferably in the range from 10,000 to 120,000 and more preferably in the range from 50,000 to 100,000.

The (co)polymeric polycarboxylates may be present in the detergents in the usual quantities and are preferably present in quantities of 1 to 10% by weight.

Also particularly preferred are biodegradable polymers of more than two different monomer units, for example those which contain salts of acrylic acid and maleic acid and vinyl alcohol or vinyl alcohol derivatives as monomers in accordance with DE-A-43 00 772 or salts of acrylic acid and 2-alkylallyl sulfonic acid and sugar derivatives as monomers in accordance with DE-C-42 21 381.

Other preferred copolymers are those described in German patent applications DE-A-43 03 320 and DE-A-44 17 734 which preferably contain acrolein and acrylic acid/acrylic acid salts or acrolein and vinyl acetate as monomers.

Other suitable builders are oxidation products of carboxyl-containing polyglucosans and/or water-soluble salts thereof which are described, for example, in International patent application WO-A-93/08251 or of which the production is described, for example, in International patent application WO-A-93/16110. Oxidized oligosaccharides according to German patent application DE-A-196 00 018 are also suitable.

Other preferred builders are polymeric aminodicarboxilic acids, salts or precursors thereof. Polyaspartic acids or salts and derivatives thereof which, according to German patent application DE-A-195 40 086, have a bleach-stabilizing effect in addition to their co-builder properties are particularly preferred.

Other suitable builders are polyacetals which may be obtained by reaction of dialdehydes with polyol carboxylic acids containing 5 to 7 carbon atoms and at least three hydroxyl groups, for example as described in European patent application EP-A-0 280 223. Preferred polyacetals are obtained from dialdehydes, such as glyoxal, glutaraldehyde, terephthal-aldehyde and mixtures thereof and from polyol carboxylic acids, such as gluconic acid and/or glucoheptonic acid.

The detergents according to the invention may additionally contain components which have a positive effect on the removability of oil and fats from textiles by washing. This effect becomes particularly clear when a textile which has already been repeatedly washed with a detergent according to the invention containing this oil- and fat-dissolving component is soiled. Preferred oil- and fat-dissolving components include, for example, nonionic cellulose ethers, such as methyl cellulose and methyl hydroxypropyl cellulose containing 15 to 30% by weight of methoxyl groups and 1 to 15% by weight of hydroxypropoxyl groups, based on the nonionic cellulose ether, and the polymers of phthalic acid and/or terephthalic acid known from the prior art or derivatives thereof, more particularly polymers of ethylene terephthalates and/or polyethylene glycol terephthalates or anionically and/or nonionically modified derlvatives thereof. Of these, the sulfonated derivatives of phthalic and terephthalic acid polymers are particularly preferred.

Other suitable ingredients of the detergents are water-soluble inorganic salts, such as bicarbonates, carbonates, amorphous silicates, such as the above-mentioned silicates dissolving with delay, or mixtures thereof; alkali metal carbonate and amorphous alkali metal silicate, above all sodium silicate with a molar $Na_2O:SiO_2$ ratio of 1:1 to 1:4.5 and preferably 1:2 to 1:3.5, are particularly suitable. The sodium carbonate content of the detergents is preferably up to 20% by weight and advantageously between 5 and 15% by weight. If it is not to be used as a builder, the sodium silicate content of the detergents is generally up to 10% by weight and preferably between 2 and 8% by weight, otherwise higher.

The other detergent ingredients include redeposition inhibitors (soil suspending agents), foam inhibitors, bleaching agents and bleach activators, optical brighteners, enzymes, fabric softeners, dyes and perfumes and neutral salts, such as sulfates and chlorides in the form of their sodium or potassium salts.

Acidic salts or slightly alkaline salts may also be used to reduce the pH value of detergents. Preferred acidifying components are bisulfates and/or bicarbonates or the above-mentioned organic polycarboxylic acids which may also be used as builders. It is particularly preferred to use citric acid which is either subsequently incorporated (standard procedure) or used—in water-free form—in the solid premix.

Among the compounds yielding $H_2O_2$ in water which serve as bleaching agents, sodium perborate tetrahydrate and sodium perborate monohydrate are particularly important. Other useful bleaching agents are, for example, sodium percarbonate, peroxypyrophosphates, citrate perhydrates and $H_2O_2$-yielding peracidic salts or peracids, such as perbenzoates, peroxophthalates, diperazelaic acid, phthaloiminoperacid or diperdodecanedioic acid. The content of bleaching agents in the detergents is preferably 5 to 25% by weight and more preferably from 10 to 20% by weight, perborate monohydrate or percarbonate advantageously being used.

Suitable bleach activators are compounds which form aliphatic peroxocarboxylic acids containing preferably 1 to 10 carbon atoms and more preferably 2 to 4 carbon atoms and/or optionally substituted perbenzoic acid under perhydrolysis conditions. Substances bearing O-and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more particularly n-nonanoyl- or isononanoyl-oxybenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran and the enol esters known from German patent applications DE-A-196 16 693 and DE-A-196 16 767, acetylated sorbitol and mannitol and the mixtures thereof (SORMAN) described in European patent application EP-A-0 525 239, acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam, which are known from International patent applications WO-A-94/27970, WO-A-94/28102, WO-A-94/28103, WO-A-95/00626, WO-A-95/14759 and WO-A-95/17498. The substituted hydrophilic acyl acetals known from German patent application DE-A-196 16 769 and the acyl lactams described in German patent application DE-A-196 16 770 and in International patent application WO-A-95/14075 are also preferably used. The combinations of conventional bleach activators known from German patent application DE-A-44 43 177 may also be used. Bleach activators such as these are present in the usual quantities, preferably in quantities of 1% by weight to 10% by weight and more preferably in quantities of 2% by weight to 8% by weight, based on the detergent as a whole.

Where the detergents are used in washing machines, it can be of advantage to add typical foam inhibitors to them. Suitable foam inhibitors are, for example, soaps of natural or synthetic origin which have a high percentage content of $C_{18-24}$ fatty acids. Suitable non-surface-active foam inhibitors are, for example, organopolysiloxanes and mixtures thereof with microfine, optionally silanized, silica and also paraffins, waxes, microcrystalline waxes and mixtures thereof with silanized silica or bis-stearyl ethylenediamide. Mixtures of different foam inhibitors, for example mixtures of silicones, paraffins and waxes, may also be used with advantage. The foam inhibitors, more particularly silicone- and/or paraffin-containing foam inhibitors, are preferably fixed to a granular water-soluble or water-dispersible support. Mixtures of paraffins and bis-stearyl ethylenediamides are particularly preferred.

The neutrally reacting sodium salts of, for example, 1-hydroxyethane-1,1-diphosphonate, diethylenetriamine pentamethylene phosphonate or ethylenediamine tetramethylene phosphonate in quantities of 0.1 to 1.5% by weight are preferably used as the salts of polyphosphonic acids.

Suitable enzymes are, in particular, enzymes from the class of hydrolases, such as proteases, lipases or lipolytic enzymes, amylases, cellulases and mixtures thereof. Oxireductases are also suitable.

Enzymes obtained from bacterial strains or fungi, such as *Bacillus subtilis, Bacillus licheniformis, Streptomyces griseus* and *Humicola insolens* are particularly suitable. Proteases of the subtilisin type are preferably used, proteases obtained from *Bacillus lentus* being particularly preferred. Of particular interest in this regard are enzyme mixtures, for example of protease and amylase or protease and lipase or lipolytic enzymes or protease and cellulase or of cellulase and lipase or lipolytic enzymes or of protease, amylase and lipase or lipolytic enzymes or protease, lipase or lipolytic enzymes and cellulase, but especially protease- and/or lipase-containing mixtures or mixtures with lipolytic enzymes. Examples of such lipolytic enzymes are the known cutinases. Peroxidases or oxidases have also proved to be suitable in some cases. Suitable amylases include in particular α-amylases, isoamylases, pullulanases and pectinases. Preferred cellulases are cellobiohydrolases, endoglucanases and β-glucosidases, which are also known as cellobiases, and mixtures thereof. Since the various cellulase types differ in their CMCase and avicelase activities, the desired activities can be established by mixing the cellulases in the appropriate ratios.

The enzymes may be adsorbed to supports and/or encapsulated in shell-forming substances to protect them against premature decomposition. The percentage content of enzymes, enzyme mixtures or enzyme granules is preferably from about 0.1 to 5% by weight and more preferably from 0.1 to about 2% by weight.

In addition to phosphonates, the detergents may contain other enzyme stabilizers. For example, 0.5 to 1% by weight of sodium formate may be used. Proteases stabilized with soluble calcium salts and having a calcium content of preferably about 1.2% by weight, based on the enzyme, may also be used. Apart from calcium salts, magnesium salts also serve as stabilizers. However, it is of particular advantage to use boron compounds, for example boric acid, boron oxide, borax and other alkali metal borates, such as the salts of orthoboric acid ($H_3BO_3$), metaboric acid ($HBO_2$) and pyroboric acid (tetraboric acid $H_2B_4O_7$).

The function of redeposition inhibitors is to keep the soil detached from the fibers suspended in the wash liquor and thus to prevent the soil from being re-absorbed by the washing. Suitable redeposition inhibitors are water-soluble, generally organic colloids, for example the water-soluble salts of polymeric carboxylic acids, glue, gelatine, salts of ether carboxylic acids or ether sulfonic acids of starch or cellulose or salts of acidic sulfuric acid esters of cellulose or starch. Water-soluble polyamides containing acidic groups are also suitable for this purpose. Soluble starch preparations and other starch products than those mentioned above, for example degraded starch, aldehyde starches, etc., may also be used. Polyvinyl pyrrolidone is also suitable. However, cellulose ethers, such as carboxymethyl cellulose (sodium salt), methyl cellulose, hydroxyalkyl cellulose, and mixed ethers, such as methyl hydroxyethyl cellulose, methyl hydroxypropyl cellulose, methyl carboxymethyl cellulose and mixtures thereof, and polyvinyl pyrrolidone are also preferably used, for example in quantities of 0.1 to 5% by weight, based on the detergent.

The detergents may contain derivatives of diaminostilbene disulfonic acid or alkali metal salts thereof as optical brighteners. Suitable optical brighteners are, for example, salts of 4,4'-bis-(2-anilino-4-morpholino-1,3,5-triazinyl-6-amino)-stilbene-2,2'-disulfonic acid or compounds of similar structure which contain a diethanolamino group, a methylamino group and anilino group or a 2-methoxyethylamino group instead of the morpholino group. Brighteners of the substituted diphenyl styryl type, for example alkali metal salts of 4,4'-bis-(2-sulfostyryl)-diphenyl, 4,4'-bis-(4-chloro-3-sulfostyryl)-diphenyl or 4-(4-chlorostyryl)-4'-(2-sulfostyryl)-diphenyl, may also be present. Mixtures of the brighteners mentioned may also be used.

EXAMPLES

Granules with the composition shown in Table 1 were produced by spray drying and, after the addition of other components as listed in Table 2, were processed in a Lödige mixer to form a premix.

TABLE 1

| Composition of the spray-dried granules [% by weight] | |
|---|---|
| $C_{9-13}$ alkyl benzenesulfonate | 26.00 |
| Sodium carbonate | 8.50 |
| Zeolite 4 A | 41.33 |
| Optical brightener | 0.42 |
| 1-Hydroxyethane-1,1-diphosphonic acid | 1.00 |
| Acrylic acid/maleic acid copolymer, Na salt | 9.50 |
| Sodium hydroxide | 0.50 |
| Salts from solution | 0.75 |
| Water | 12.00 |

TABLE 2

| Composition of the premix [% by weight] | |
|---|---|
| Spray-dried granules (Table 1) | 59.0 |
| Sodium perborate monohydrate | 20.0 |
| $C_{12-18}$ fatty alcohol + 7 EO | 7.0 |
| $C_{12-18}$ fatty alcohol sulfate, 92% | 7.5 |

TABLE 2-continued

| Composition of the premix [% by weight] | |
|---|---|
| Polyethylene glycol 4000 | 6.0 |
| Perfume oil | 0.5 |

The perfume oil was dissolved in the liquid $C_{12-18}$ fatty alcohol +7 EO before being introduced into the mixer. After leaving the mixer, the free-flowing premix had a bulk density of 450 g/l and was introduced into a Lihotz twin-screw extruder in which it was plasticized and extruded under pressure.

The plasticized premix left the extruder under a pressure of 85 bar through a multiple-bore die (bore diameter 1.4 mm). The extruded strands were cut by a rotating blade to a length-to-diameter ratio of about 1 and were rounded off in a Marumerizer®. After the fine particles (<0.4 mm) and coarse particles (>2.0 mm) had been removed by sieving, the extrudate had a bulk density of 810 g/l.

Extrudates E1 and E2 produced in accordance with the invention, which differed in the perfume oils used, were then compared with extrudates C1 and C2 of similar composition where the particular perfume oils had been conventionally sprayed onto the extruded and rounded particles which had been powdered with fine-particle zeolite.

In order to demonstrate the variant according to the invention where the perfumes are divided, another extrudate E3 was produced which contained part of the perfume and, in addition, was sprayed with the rest of the perfume. This extrudate was compared with an extrudate C3 where all the perfume had been applied by spraying.

The composition of the perfume oils is shown in Table 3. The perfuming of the product and of treated textiles (cotton) was evaluated by perfumists as a subjective odor impression. The figures in the evaluation Table (Table 4) indicate the number of perfumists which classified the particular products or the textiles treated with them as "fairly strongly perfuming". Since a different number of perfumists was present in the various perfume tests, the values in the "perfumists" columns do not always add up to the same figure. Accordingly, the first block of the first column (product) should be interpreted to mean that 5 out 7 perfumists evaluated the extrudates produced in accordance with the invention as fairly strongly perfuming. The results of the perfume tests are set out in Table 4.

TABLE 3

| Composition of the perfume oils [% by weight] | |
|---|---|
| Perfume oil 1 | |
| Bergamot oil | 15.0 |
| Dihydromyrcenol | 20.0 |
| Citrus oil messina | 7.5 |
| Mandarin oil | 2.5 |
| Orange oil sweet | 5.0 |
| Allyl amyl glycolate | 2.0 |
| Cyclovertal | 0.5 |
| Lavandin oil grosso | 2.5 |
| Clary oil | 1.0 |
| Lilial | 2.0 |
| β-Damascone | 0.1 |
| Geranium oil bourbon | 3.0 |
| Hedione | 5.0 |
| Cyclohexyl salicylate | 4.0 |
| Vertofix Coeur | 10.0 |

TABLE 3-continued

| Composition of the perfume oils [% by weight] | |
|---|---|
| Iso-E-super | 5.0 |
| Ambroxan | 1.6 |
| Ethylene brassylate | 10.0 |
| Evernyl | 1.0 |
| Dipropylene glycol (DPG) | 2.3 |
| Perfume oil 2 | |
| Phenyl ethyl alcohol | 52.0 |
| Dimethyl benzyl carbinyl acetate | 2.5 |
| Iraldein gamma | 5.0 |
| Phenyl acetic acid | 0.5 |
| Geranyl acetate | 2.0 |
| Benzyl acetate | 30.0 |
| Rose oxide L 10% in DPG | 2.5 |
| Romilate | 20.0 |
| Irotyl | 0.5 |
| Cyclohexyl salicylate | 20.0 |
| Floramate | 10.0 |

TABLE 4

Perfume enhancement (intensity preference)

| | Perfumists (intensity preference) | | |
|---|---|---|---|
| | Product | Damp laundry | Dry laundry |
| E1 (0.5% perfume oil 1 in extrudate) | 5 | 5 | 4 |
| C1 (0.5% perfume oil 1 sprayed on) | 2 | 2 | 3 |
| E2 (0.5% perfume oil 2 in extrudate) | 4 | 5 | 4 |
| C2 (0.5% perfume oil 2 sprayed on) | 2 | 1 | 2 |
| E3 (0.3% perfume oil 2 in extrudate, 0.2% sprayed on) | 5 | 6 | 5 |
| C3 (0.5% perfume oil 2 sprayed on) | 1 | 2 | 0 |

What is claimed is:

1. A process for the production of perfume-enhanced detergents or detergent components with bulk densities above 600 g/l, comprising a) preparing a solid, substantially water-free premix, containing at least 0.1% by weight of perfume, based on the premix, comprising at least one member selected from the group consisting of detergent compounds and detergent raw materials and b) press agglomerating the premix.

2. The process as claimed in claim 1 wherein the premix has a total water content of not more than 15% by weight, the water not being present in a free form and wherein the content of water not bound to at least one of zeolite and silicates being not more than 10% by weight.

3. The process as claimed in claim 1 wherein the premix contains materials which are present as solids at room temperature and 1 bar pressure and which have a melting point or softening point no lower than 45° C. and, optionally, up to 10% by weight based on the premix of nonionic surfactants liquid at temperatures below 45° C. and 1 bar pressure.

4. The process as claimed in claim 1 wherein in addition to the solid constituents, the premix contains up to 10% by weight, of nonionic surfactants liquid at temperatures below 45° C. and 1 bar pressure, the liquid nonionic surfactants being added in the form of a mixture with the perfume.

5. The process as claimed in claim 1 wherein the premix contains at least one material which is present in solid form at temperatures below 45° C. and 1 bar pressure, but which exists as a melt during the press agglomeration step, the melt acting as a polyfunctional water-soluble binder which, in the production of the detergents, acts both as a lubricant and as an adhesive for the solid detergent materials, but as a disintegrator during the redissolution of the detergent in water.

6. The process as claimed in claim 1 wherein the premix contains one or more binders which dissolve almost completely in 90 seconds in a concentration of 8 g binder to 1 liter water at 30° C.

7. The process as claimed in 1 wherein the premix contains binders which exist completely as a melt at temperatures of 130° C.

8. The process as claimed in claim 1 wherein the binder is introduced into the premix as the last component, under such conditions that the binder is uniformly distributed in the mixture of solids as a solidified melt or as a powder.

9. The process as claimed in claim 1 wherein the binder is incorporated into the premix at a temperature at which the binder exists as a melt.

10. The process as claimed in claim 1 wherein mixing is continued until the melt has solidified and the premix comprises a solid, free-flowing material.

11. The process as claimed in 1 wherein the premix comprises a binder content of at least 1% by weight to less than 10% by weight based on the premix.

12. The process as claimed in claim 1 wherein immediately after leaving a production unit, the press agglomerated material has temperatures no higher than 90° C.

13. The process as claimed in claim 1 wherein the premix contains more than 0.15% by weight of perfume.

14. The process as claimed in claim 1 wherein at least a portion of the solids forming the premix is introduced into a mixer and/or granulator at room temperature and the perfume is introduced to the moving bed of solids.

15. The process as claimed in claim 1 wherein the perfume is added to the solids together with a binder.

16. The process as claimed in claim 1 wherein the press agglomeration step is carried out by at least one method selected from the group consisting of extrusion, roller compacting, pelleting and tabletting.

17. The process as claimed in claim 16, wherein the tools of the press agglomerator are at a temperature of at most 150° C. and the process temperature is at most 30° C. above the melt temperature or the upper temperature limit to the melting range of the binder.

18. The process as claimed in claim 16 wherein the heat exposure time in the compression zone of the press agglomerators is at most 2 minutes.

19. The process as claimed in claim 1 wherein press agglomerating is carried out by extrusion, wherein the premix is compacted under pressure, plasticized, extruded in strand form through a multiple-bore die in an extruder head and, finally, is size-reduced by a rotating blade, to form substantially spherical or cylindrical granules, the temperature in the transition section of the extruder screw, the predistributor and the extrusion die being controlled in such a way that the melting temperature of the binder or the upper limit to the melting range of the binder is at least reached.

20. The process as claimed in claim 1 wherein the agglomerating is carried out by roller compacting wherein the premix is compacted under pressure, plasticized, forced between rollers to form a sheet-form compactate and size-reduced to granules by means of a cutting and size-reducing unit.

21. The process as claimed in claim 1 wherein the agglomerating is carried out by pelleting, wherein the premix is compacted under pressure, plasticized, forced through a perforated plate in the form of fine strands by means of a rotating roller, and finally, is size-reduced to granules by means of a chopping unit.

22. A perfume-enhanced detergent wherein at least 80% by weight consists of components produced in accordance with the process of claim 1.

23. The perfume-enhanced detergent as claimed in claim 22, comprising fine-particle ingredients bonded together by melt agglomeration as an outer shell.

24. The perfume-enhanced detergent as claimed in claim 14, which has been subsequently sprayed with perfume.

25. The perfume-enhanced detergent as claimed in claim 24, wherein at least 30% by weight of the total perfume present in the detergent has been introduced into the detergent before or during this agglomerated step.

26. The perfume-enhanced detergent as claimed in claim 26 wherein the proportion of the perfume introduced during the production process comprises firmly adhering perfumes.

27. A perfume-enhanced detergent as claimed in claim 26 wherein the proportion of perfume introduced into the detergent by the production process comprises mainly readily volatile perfumes.

* * * * *

UNITED STATES PATENT AND TRADEMARK OFFICE

CERTIFICATE OF CORRECTION

PATENT NO. : 6,228,833 B1
DATED : May 8, 2001
INVENTOR(S) : Paatz et al.

It is certified that error appears in the above-identified patent and that said Letters Patent is hereby corrected as shown below:

Column 29,
Line 10, delete “14”, and insert therefor -- 22 --.

Column 30,
Line 4, delete “26”, and insert therefor -- 25 --.
Line 6, delete “26”, and insert therefor -- 25 --.

Signed and Sealed this

Second Day of September, 2003

JAMES E. ROGAN
*Director of the United States Patent and Trademark Office*